US011193239B2

(12) United States Patent
Lee et al.

(10) Patent No.: US 11,193,239 B2
(45) Date of Patent: Dec. 7, 2021

(54) METHOD FOR PREPARING NANOCELLULOSE

(71) Applicant: LG ELECTRONICS INC., Seoul (KR)

(72) Inventors: Misun Lee, Seoul (KR); Eunseck Kang, Seoul (KR); Koun Park, Seoul (KR); Dongwook Lee, Seoul (KR); Kyungho Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 64 days.

(21) Appl. No.: 16/151,801

(22) Filed: Oct. 4, 2018

(65) Prior Publication Data

US 2019/0309477 A1 Oct. 10, 2019

(30) Foreign Application Priority Data

Apr. 6, 2018 (KR) ..... 10-2018-0040543

(51) Int. Cl.

| | |
|---|---|
| ***D21H 11/18*** | (2006.01) |
| ***D21C 9/00*** | (2006.01) |
| ***D21H 11/20*** | (2006.01) |
| ***D21B 1/14*** | (2006.01) |

(52) U.S. Cl.

CPC ..... *D21H 11/18* (2013.01); *D21B 1/14* (2013.01); *D21C 9/004* (2013.01); *D21C 9/007* (2013.01); *D21H 11/20* (2013.01)

(58) Field of Classification Search

CPC ..... D21C 9/001–9/008

See application file for complete search history.

(56) References Cited

U.S. PATENT DOCUMENTS

| | | | | |
|---|---|---|---|---|
| 4,294,731 | A * | 10/1981 | Allen | A61L 15/28 106/175.1 |
| 2016/0115249 | A1* | 4/2016 | Noguchi | D21H 13/06 536/62 |
| 2020/0063292 | A1* | 2/2020 | Matsusue | D01F 1/10 |

FOREIGN PATENT DOCUMENTS

| | | | |
|---|---|---|---|
| JP | 2005-120188 | A | 5/2005 |
| JP | 2017-66272 | A | 4/2017 |
| JP | 2017-66273 | A | 4/2017 |
| JP | 2017-66274 | A | 4/2017 |
| JP | 2017-218525 | A | 12/2017 |

OTHER PUBLICATIONS

Banzashi, Complete nanofibrillation of cellulose prepared by acid esterification, Jun. 2016, 2016 International Conference on Nanotechnology for Renewable Materials. (Year: 2016).*

(Continued)

*Primary Examiner* — Anthony Calandra

(74) *Attorney, Agent, or Firm* — Birch, Stewart, Kolasch & Birch, LLP

(57) ABSTRACT

A method according to the present disclosure may includes preparing a urea solution by dissolving urea in distilled water, adding phosphoric acid to the urea solution, adding pulp to the solution in which urea and phosphoric acid are dissolved, heating the solution such that the urea and the phosphoric acid each react with the pulp and preparing nanocellulose by washing the pulp which is completely reacted, and then grinding the pulp, in which a weight of the phosphoric acid is 10 to 50% based on a weight of the pulp.

4 Claims, 6 Drawing Sheets

(56) References Cited

OTHER PUBLICATIONS

Meyers, Why is Distilled Water a good Control for Science Projects [downloaded online from archive.org], Mar. 2, 2017 [downloaded on Feb. 14, 2020], (Year: 2017).*
Wegner et al., Fundamental Review of the Relationships between Nanotechnology and Lignocellulosic Biomass (A chapter of the Nanoscience and Technology of Renewable Biomaterials), 2009, Blackwell Publishing, (Year: 2009).*
Translated foreign priority document (May 15, 2017) of US 2020/063292. (Year: 2017).*
Ghanadpour et al., Phosphorylated Cellulose Nanofibrils: A Renewable Nanomaterial for the Preparation of Intrinsically Flame-Retardant Materials, Aug. 2015, Biomacromolecules, 16, 3399-3410 (Year: 2015).*

* cited by examiner

METHOD FOR PREPARING NANOCELLULOSE

CROSS-REFERENCE TO RELATED APPLICATION

Pursuant to 35 U.S.C. § 119(a), this application claims the benefit of earlier filing date and right of priority to Korean Application No. 10-2018-0040543, filed on Apr. 6, 2018, the contents of which is incorporated by reference herein in its entirety.

FIELD OF THE DISCLOSURE

The present disclosure relates to a method for preparing nanocellulose using a carbamate-ester reaction.

BACKGROUND OF THE DISCLOSURE

Nanocellulose is an eco-friendly material which has a nanometer-level diameter as a crystalline portion of cellulose which is a main component of plant cell walls, and is excellent in mechanical characteristics due to hydrogen bonds between molecules. The nanocellulose is a carbon-neutral material and can be applied to an eco-friendly composite material, a transparent film, and the like as a reinforcing agent, and a preparation method thereof may be largely classified into three types. Specifically, there are a nanofiberization method through mechanical grinding and chemical dissolution by extraction from wood and biomass, and a preparation method through a biological culture from bacterial metabolism.

The mechanical grinding is a grinding method by adding repeated force to pulp, and there are methods such as grinding, water-jet, a homogeneous method, a beating method, an extrusion method, and a ball-mill method, and nanocellulose prepared by the methods has disadvantages in that the fiber shape is irregular and the energy consumption is large at the time of preparation but has been frequently used as a reinforcing material of a composite material because the fiber aspect ratio is relatively high.

A chemical treatment method is a method of selectively separating only a crystalline portion by using the solubility difference, examples thereof include a hydrolysis method, an oxidation method, an ion solvent method, and the like, and nanocellulose obtained by the method has been applied as an additive such as a thickener and a dispersant because a short fiber having a relatively low aspect ratio is obtained.

Finally, a biological culture method has advantages in that a product is made through the metabolism of viruses, and bacterial nanofibers obtained by sterilizing and washing the product do not have non-crystalline impurities such as hemicellulose and lignin, but the application field thereof is limited to a high-priced medical application, such as artificial skin or a medical patch because the synthesis time is long and culture conditions are tricky.

The present disclosure relates to a method for preparing nanocellulose through mechanical grinding and suggests a chemical pretreatment method capable of reducing mechanical grinding energy.

SUMMARY OF THE DISCLOSURE

Therefore, an object of the present disclosure is to provide a method for preparing nanocellulose capable of reducing mechanical grinding energy when the nanocellulose is prepared through mechanical grinding.

Another object of the present disclosure is to provide a method for preparing nanocellulose having a high thermal stability.

Still another object of the present disclosure is to provide a method for preparing nanocellulose having a high aspect ratio of particles.

To achieve these and other advantages and in accordance with the purpose of the present disclosure, as embodied and broadly described herein, there is provided a method for preparing nanocellulose, the method including: preparing a urea solution by dissolving urea in distilled water; adding phosphoric acid to the urea solution; adding pulp to the solution in which urea and phosphoric acid are dissolved; heating the solution such that the urea and the phosphoric acid each react with the pulp; and preparing nanocellulose by washing the pulp which is completely reacted, and then grinding the pulp, in which a weight of the phosphoric acid is 10 to 50% based on a weight of the pulp.

In an Example, a weight of the urea may be twice or more the weight of the phosphoric acid.

In an Example, the heating of the solution such that the urea and the phosphoric acid each react with the pulp may be performed at a temperature of 100 to 250° C.

In an Example, the nanocellulose may have an average diameter of 50 nm or less.

In an Example, the nanocellulose may have an average length of 2 μm or more.

In an Example, the nanocellulose may have a thermal degradation temperature of 286 to 302° C.

According to the present disclosure, by introducing both a carbamate group and a phosphoric acid group into cellulose, damage to fibers caused by acid may be reduced, thereby enhancing a thermal stability of nanocellulose and simultaneously facilitating preparation of nanocellulose by mechanical grinding.

DETAILED DESCRIPTION OF THE DISCLOSURE

Figure 1:
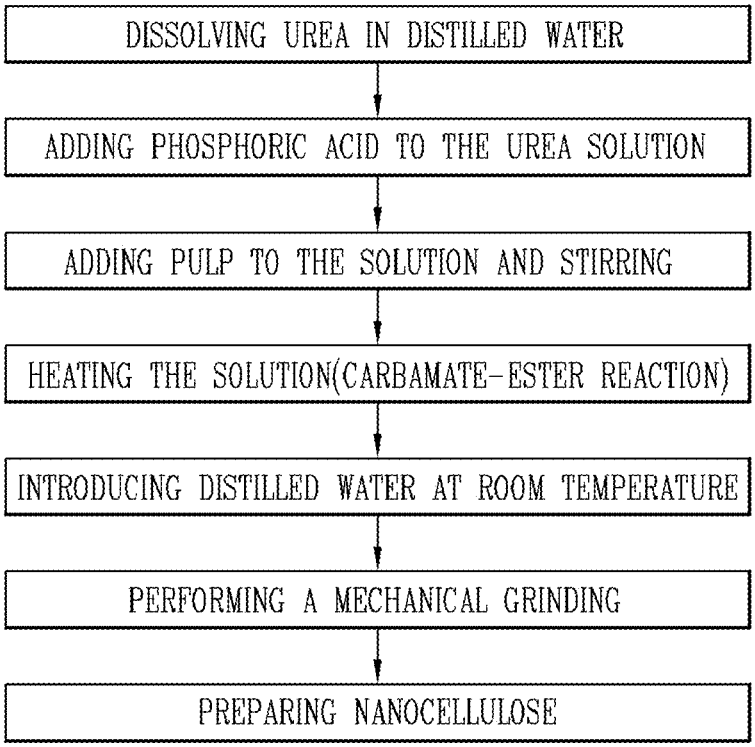
FIG. 1 is a flow chart illustrating a preparation method according to the present disclosure.

Reference will now be made in detail to the preferred embodiments of the present disclosure, examples of which are illustrated in the accompanying drawings. It will also be apparent to those skilled in the art that various modifications and variations can be made in the present disclosure without departing from the spirit or scope of the disclosure. Thus, it is intended that the present disclosure cover modifications and variations of this disclosure provided they come within the scope of the appended claims and their equivalents.

Description will now be given in detail of a drain device and a refrigerator having the same according to an embodiment, with reference to the accompanying drawings.

Hereinafter, examples disclosed in the present specification will be described in detail with reference to the accompanying drawings, the same reference numerals are given to the same or similar constituent elements irrespective of the drawing signs, and the repeated description thereof will be omitted. Further, when it is determined that the detailed description of the publicly known art related in describing the examples disclosed in the present specification may obscure the gist of the examples disclosed in the present specification, the detailed description thereof will be omitted. In addition, the accompanying drawings are provided to easily understand the examples disclosed in the present specification, and it is to be appreciated that the technical spirit disclosed in the present specification is not limited by the accompanying drawings, and the accompanying drawings include all the modifications, equivalents, and substitutions included in the spirit and the technical scope of the present disclosure.

Terms including an ordinal such as a first and a second may be used to explain various constituent elements, but the constituent elements are not limited by the terms. The terms are used only to distinguish one constituent element from another constituent element.

Singular expressions include plural expressions unless the singular expressions have definitely opposite meanings in the context.

In the present application, the term "include" or "have" is intended to indicate the presence of a characteristic, number, step, operation, constituent element, part or any combination thereof described in the specification, and should be understood that the presence or addition possibility of one or more other characteristics or numbers, steps, operations, constituent elements, parts or any combination thereof is not pre-excluded.

In the related art, mechanical grinding of cellulose was facilitated through a pretreatment process of introducing a phosphoric acid group into cellulose. However, since damage to fibers is inevitable due to an acid treatment in the process of introducing a phosphoric acid group, there is a problem in that it is difficult to control the particle size of prepared nanocellulose. Further, the nanocellulose into which a phosphoric acid group is introduced has a problem in that the thermal stability is low.

The present disclosure minimizes damage to fibers caused by acid in a high temperature reaction and improves the thermal stability of the fibers by using an aqueous urea solution as a solvent when a wood or biomass raw material is subjected to acid treatment. Specifically, the present disclosure provides a method capable of easily preparing nanocellulose even by a low-energy mechanical grinding by simultaneously using a carbamate reaction between urea and cellulose and an esterification reaction between phosphoric acid and cellulose to improve repulsive force between nanofibers. The carbamate reaction refers to a reaction in which when urea is thermally degraded into isocyanic acid and ammonia, the unstable isocyanic acid reacts with a hydroxyl group (—OH) on the surface of cellulose to form a carbamate group (—CONH2). Since the carbamate group has a large volume and a strong anionic property, a strong ion repulsive force occurs between fibers in which the carbamate group is functionalized, so that nanocellulose may be efficiently prepared even by a relatively low-energy grinding by preventing hydrogen bonds between the fibers.

The esterification reaction refers to a reaction in which acid reacts with a hydroxyl group (—OH) on the surface of cellulose to produce an ester compound, and the functional group also has a strong anionic property, thereby contributing to the induction of repulsive force between cellulose nanofibers. In addition, an ester group may be additionally formed on the carbamate group formed on the surface of a cellulose fiber, and further, the carbamate group may continuously react with the ester group to enable formation of a large functional group, thereby maximizing an ion repulsive force between fiber surfaces due to the anionic functional group having a large volume.

Hereinafter, a preparation method according to the present disclosure will be described.

Figure 2A:
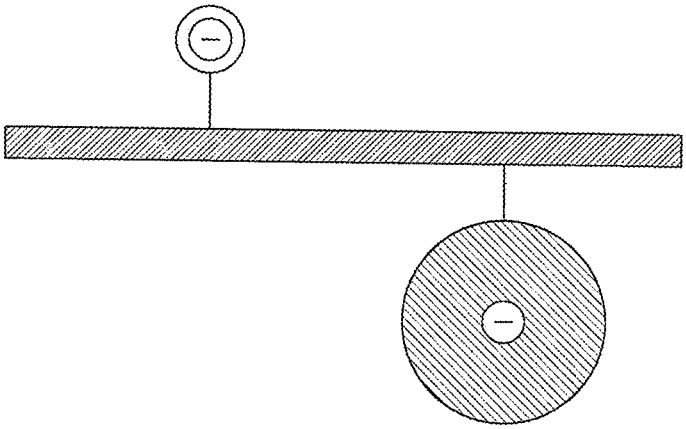
FIGS. 2A to 2C are conceptual views illustrating aspects in which a carbamate group and a phosphoric acid group are bonded to fiber.
Figure 2B:
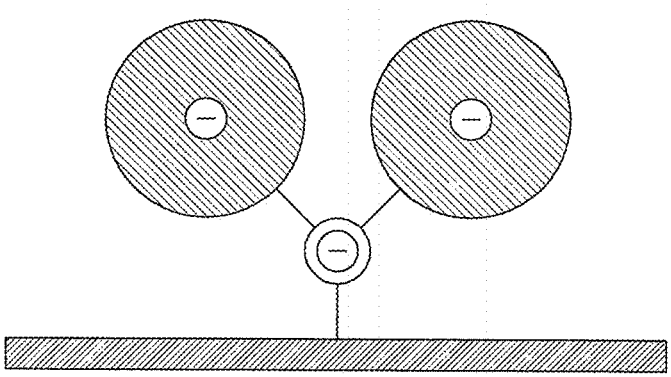
Figure 2C:
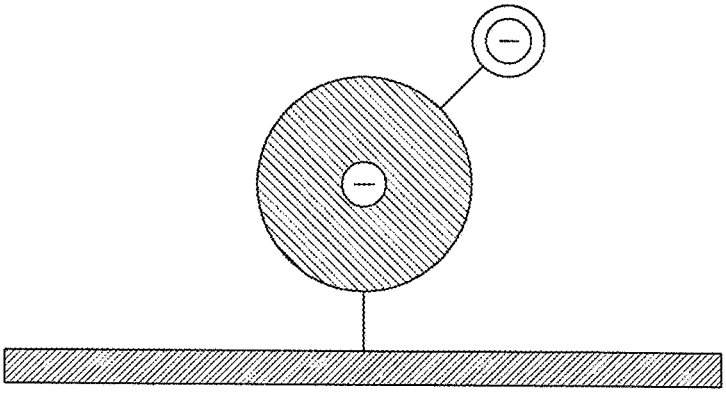

FIG. 1 is a flow chart illustrating a preparation method according to the present disclosure, and FIGS. 2A to 2C are conceptual views illustrating aspects in which a carbamate group and a phosphoric acid group are bonded to fiber.

First, in the preparation method according to the present disclosure, a step of dissolving urea in water is performed. It is preferred that a mixing ratio of water to urea is a weight ratio of 1:1 to 1:3. It is preferred that the process of dissolving urea is performed at 30 to 80° C.

Next, a step of adding phosphoric acid to the urea solution and a step of adding pulp are performed. The concentration of phosphoric acid is a condition that has the greatest effect on properties of nanocellulose. In particular, the weight ratio of pulp to phosphoric acid largely affects properties of nanocellulose.

Specifically, it is preferred that a weight of the phosphoric acid is 10 to 50% based on a weight of the pulp. Meanwhile, when phosphoric acid is excessively introduced, damage to fibers constituting pulp becomes severe, and the urea prevents fibers from being damaged. For this reason, it is preferred that the urea is at least twice or more the amount of phosphoric acid added.

It is preferred that the pulp is added in a state where a surface area capable of being reacted through defibration, beating, or a mixer is improved. The amount of pulp introduced as compared to a solvent is limited to the degree to which pulp is sufficiently impregnated. Through this, the amount of waste after nanocellulose is prepared may be minimized.

Next, a step of performing a carbamate-ester reaction by heating the solution to which the urea, the phosphoric acid, and the pulp are added is performed.

Here, it is preferred that the reaction temperature is 100 to 250° C., such that urea is thermally degraded, and as a result, a carbamate reaction occurs. More preferably, the reaction temperature may be 120 to 200° C. When the reaction temperature is less than 100° C., the carbamate reaction does not occur, and when the reaction temperature is more than 250° C., thermal damage to fibers may occur.

Meanwhile, it is preferred that the reaction time is 30 minutes to 4 hours. When the reaction time is less than 30 minutes, the carbamate-ester reaction may not sufficiently occur, and when the reaction time is more than 4 hours, thermal damage to fibers may occur.

When the carbamate-ester reaction is completed, a step of introducing distilled water at room temperature, stirring the resulting mixture, and then washing the product is performed. The washing process is performed by using a sieve and is performed until the pH of the solution becomes neutral. In order to neutralize the solution, it is preferred that the washing is performed at least three times.

Finally, a step of performing a mechanical grinding is performed. For the mechanical grinding, it is possible to use a water-jet grinder, a high-speed defibrating machine, a grinder, a high-pressure homogenizer, a high-pressure impact-type grinder, a ball mill, a beads mill, a disc-type refiner, a conical refiner, a twin-screw kneader, a vibration mill, a homomixer under a high-speed rotation, an ultrasonic dispersing machine, a beater, or the like.

When the carbamate-ester reaction is completed, both a carbamate group and a phosphoric acid group are bonded to fibers. As in FIG. 2A, the carbamate group (a larger anion) and the phosphoric acid group (a smaller anion) may be each bonded to fibers. In contrast, referring to FIGS. 2B and 2C, the carbamate group and the phosphoric acid group may be bonded to fibers in a state where the two groups are bonded to each other. Accordingly, the size of the functional group bonded to fibers may become large. Due to strong repulsive force occurring between large anions, separation between fibers becomes facilitated. For this reason, nanocellulose may be prepared even by a mechanical grinding at a small energy.

Hereinafter, the present disclosure will be described in more detail through the Examples and the Experimental Examples. However, the scope and content of the present disclosure are not interpreted to be curtailed or limited by the Examples and the Experimental Examples to be described below.

Example. Mechanical Grinding after Carbamate-Ester Reaction

After 600 g of urea was dissolved in 600 g of water, 300 g of phosphoric acid was added thereto. Thereafter, after 600 g of pulp was added thereto, a carbamate-ester reaction was performed at a temperature of about 150° C. Thereafter, a mechanical grinding was repeated 10 times by using a grinder.

Comparative Example. Mechanical Grinding after Pretreatment with Phosphoric Acid Ester After 300 g of phosphoric acid was added to 600 g of water, a phosphorylation reaction was performed by adding 600 g of pulp thereto. Thereafter, a mechanical grinding was repeated 20 times by using a grinder.

Figure 3A:
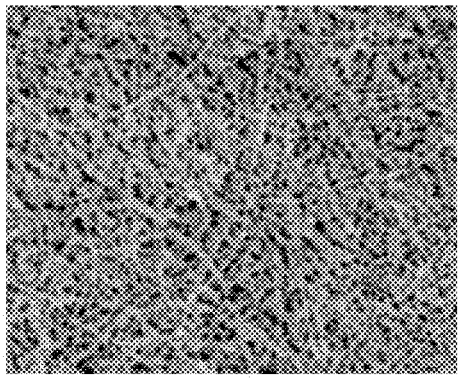
FIGS. 3A to 3F are SEM photographs of nanocellulose according to an Example of the present disclosure.
Figure 3B:
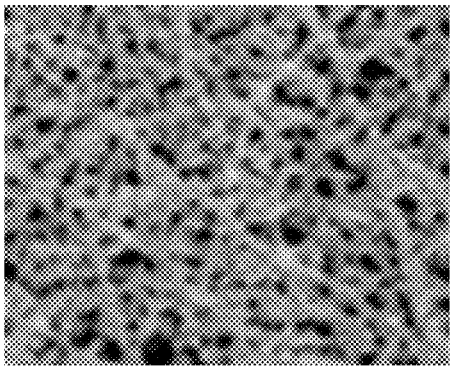
Figure 3C:
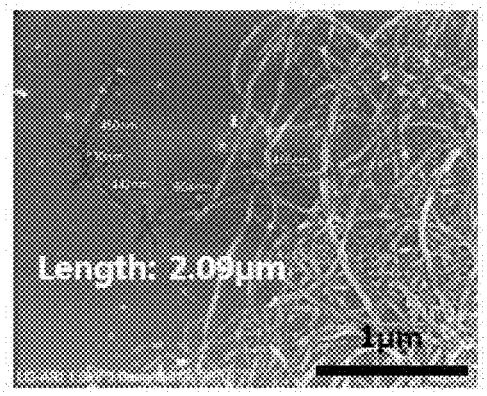
Figure 3D:
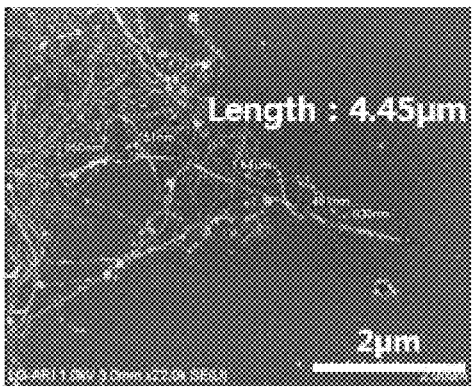
Figure 3E:
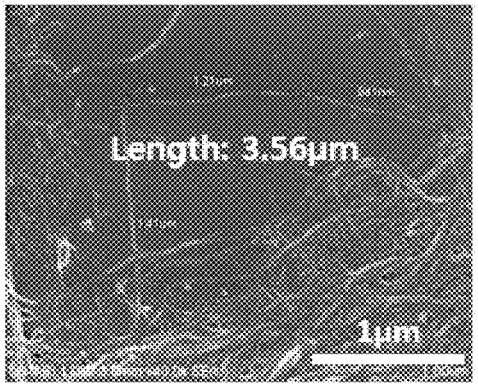
Figure 3F:
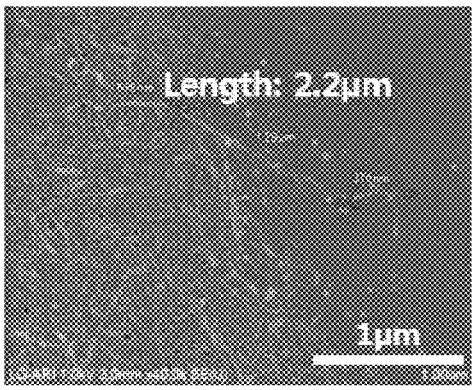
Figure 4A:
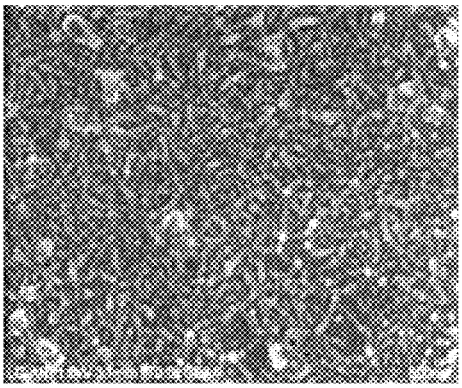
FIGS. 4A to 4C are SEM photographs of nanocellulose in the related art.
Figure 4B:
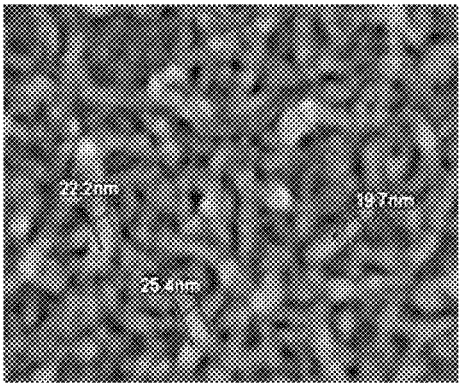
Figure 4C:
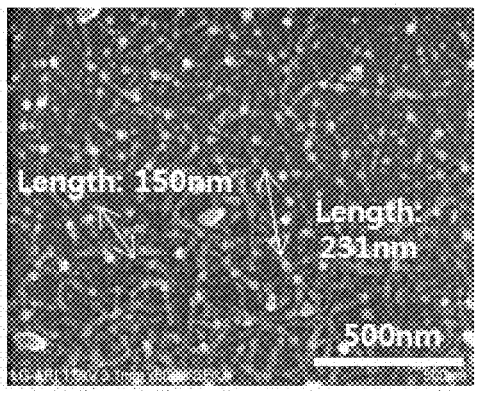

The nanocellulose (hereinafter, referred to as Example) prepared according to the Example is illustrated in FIGS. 3A to 3F, and the nanocellulose (hereinafter, referred to as Comparative Example) prepared according to the Comparative Example is illustrated in FIGS. 4A to 4C.

When FIG. 3B is compared with FIG. 4B, the Comparative Example has a short fiber (rod) shape having an irregular diameter (a diameter of 19.7 to 25.4 nm) due to the damage. It can be confirmed that the Example has a relatively high aspect ratio and a uniform diameter.

Meanwhile, when FIGS. 3C to 3F are compared with FIG. 4C, it can be confirmed that in the case of the Comparative Example, the fibers have a length of 150 to 231 nm, whereas in the case of the Example, the fibers have a length of 2.09 to 4.45 μm.

In summary, in the case of the Comparative Example, the diameter is 35 nm or less, and the length is 1 μm. Meanwhile, in the case of the Example, the diameter is about 50 nm, and the length is 2 μm or more.

As described above, it can be confirmed that according to the present disclosure, it is possible to prepare fibers having a higher aspect ratio and a more uniform diameter than the nanocellulose pretreated with phosphoric acid.

Experimental Example 1. Comparison of Thermal Stability Between Nanocellulose in the Related Art and Nanocellulose According to the Present Disclosure The thermal degradation temperatures in the Experimental Example and the Comparative Example were measured by using STA (TG-DSC) and STA409PA (Netzch Co., Ltd.). The heating rate was 10 K/min, and the temperature range was within 30 to 600° C. Further, the thermal degradation temperature was measured in the air atmosphere. As a result of measurement, the thermal degradation temperature in the Example was 301.9° C., and the thermal degradation temperature in the Comparative Example was 232.2° C. For reference, the thermal degradation temperature of the nanocellulose prepared without any pretreatment was about 309° C.

Figure 5:
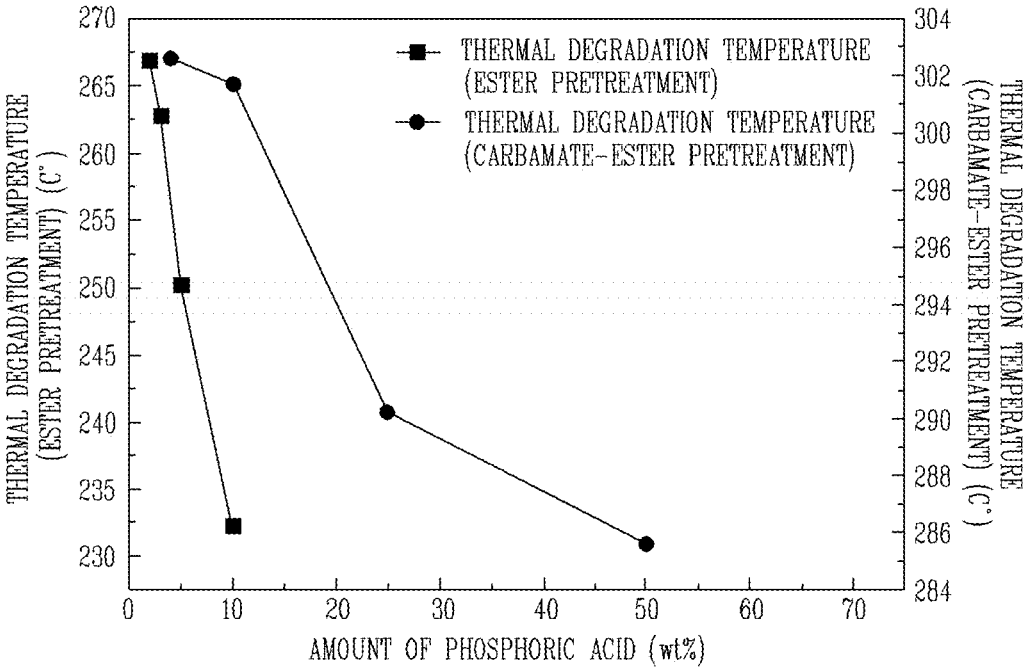
FIG. 5 is a conceptual view illustrating a thermal degradation temperature of nanocellulose according to the amount of phosphoric acid added.

Meanwhile, the thermal degradation temperature according to the amount of phosphoric acid added for the nanocellulose prepared through a phosphoric acid ester pretreatment and the thermal degradation temperature according to the amount of phosphoric acid added for the nanocellulose according to the present disclosure were measured by the above-described method. The measurement results are illustrated in FIG. 5.

In the case of the phosphoric acid ester pretreatment, the thermal degradation temperature was decreased to 230° C. even though the amount of phosphoric acid added was increased by only 10 wt %. However, in the case of the nanocellulose according to the present disclosure, it can be confirmed that the thermal degradation temperature was 285° C. even though the amount of phosphoric acid added was increased by 50 wt %.

As described above, it can be confirmed that the nanocellulose according to the present disclosure has a higher thermal stability than that of the nanocellulose in the related art, which is pretreated with phosphoric acid.

Experimental Example 2. Comparison of Mechanical Characteristics Between Nanocellulose in the Related Art and Nanocellulose According to the Present Disclosure Fiber sheets were prepared by using each of the Example and pulp which was not pretreated. Specifically, 200 mL of a 0.2 wt % nanofiber suspension was prepared as the Example in the form of a solid content. Thereafter, the nanofiber suspension was dispersed for 1 minute by using an ultrasonic dispersing machine, and then a filtered product in the form of a gel was obtained by filtering the nanofiber suspension using a reduced pressure filtration apparatus. After the filtered product was compressed under a pressure of 20 MPa on a press at a temperature of 100° C. for 10 minutes, a fiber sheet (hereinafter, referred to as the fiber sheet according to the Example) was prepared by dehydrating and drying the filtered product.

Meanwhile, 2 wt % of pulp which had not been pretreated was defibrated in water, the defibrated pulp was coarsely ground (a rotation speed of 1,500 rpm and a disc gap of −150 um) 10 times by using a grinder (MKCA6-1, Masuko Sangyo Co., Ltd., Japan), and then the pulp was ground 10 times by using a water-jet grinding apparatus in order to micronize 1 wt % of the coarsely ground solution. Thereafter, a fiber sheet (hereinafter, referred to as a fiber sheet in the related art) was prepared by a method which is the same as the method of preparing a fiber sheet from the Example.

Thereafter, each tensile strength of the fiber sheet according to the Example and the fiber sheet in the related art was measured. After a sample in the form of a rectangle (a width of 5 mm, a length of 50 mm, and a thickness of 0.7 mm) was manufactured, the tensile strength was measured at a cross-head speed of 10 mm/min by using a universal testing machine (TXA UTA500, manufactured by YEONJIN S-Tech Ltd.).

As a result of the measurement, the tensile strength of the fiber sheet according to the Example was 151.1 MPa, and the tensile strength of the fiber sheet in the related art was 120.9 MPa.

Meanwhile, the two sheets were photographed by SEM. The diameters of the particles constituting the fiber sheet according to the Example were 50 nm or less, and the diameters of the particles constituting the fiber sheet in the related art were several μm. Further, it could be confirmed that the aspect ratios of the particles constituting the fiber sheet according to the Example were higher than those of the particles constituting the fiber sheet in the related art.

Through the tensile strength experiment, it could be confirmed that the bonding strength of particles of the nanocellulose according to the present disclosure was higher than that of particles of the nanocellulose in the related art. This is determined to be because the nanocellulose according to the present disclosure has smaller diameters than those of the nanocellulose in the related art, and thus has more hydrogen bond sites and higher aspect ratios of particles than those of the nanocellulose in the related art.

As described above, when the nanocellulose prepared by the preparation method according to the present disclosure is used, a fiber sheet having high tensile strength and high thermal stability may be prepared.

It is obvious to the person skilled in the art that the present disclosure can be embodied in other specific forms without departing from the spirit and essential characteristics of the present disclosure.

Further, the aforementioned detailed description should not be interpreted as limitative in all aspects and should be considered as illustrative. The scope of the present disclosure should be defined by the reasonable interpretation of the accompanying claims, and all the modifications within the equivalent scope of the present disclosure are included in the scope of the present disclosure.

What is claimed is:

1. A method for preparing nanocellulose, the method comprising:

preparing a urea solution by dissolving urea in distilled water;

adding phosphoric acid to the urea solution to form a solution;

adding pulp to the solution in which the urea and the phosphoric acid are dissolved;

heating the solution such that the urea and the phosphoric acid each react with the pulp; and preparing nanocellulose by washing the pulp which is completely reacted in a washing process, and then grinding the pulp, wherein the preparing of the urea solution includes dissolving the urea by heating at 30° C. to 80° C., and a mixing ratio of distilled water and the urea added is a weight ratio of 1:1 to 1:3, wherein a weight of the phosphoric acid is 10% to 50% based on a weight of the pulp, wherein the heating of the solution is to form a carbamate group and an ester group by reacting the urea and the phosphoric acid with a hydroxyl group, wherein the urea reacts with the hydroxyl group (—OH) of the pulp to form the carbamate group (—$CONH_2$), wherein a phosphoric acid group reacts with the carbamate group (—$CONH_2$) to form the ester group, and wherein the carbamate group continuously reacts with the phosphoric acid group to form an anionic functional group.

2. The method of claim 1, wherein the heating of the solution such that the urea and the phosphoric acid each react with the pulp is performed at a temperature of 100° C. to 250° C.

3. The method of claim 1, wherein the nanocellulose has an average diameter of 50 nm or less.

4. The method of claim 3, wherein the nanocellulose has an average length of 2 μm or more.

* * * * *